United States Patent [19]

Miyano et al.

[11] 4,441,001

[45] Apr. 3, 1984

[54] KEYBOARD FOR INPUTTING PLURAL LETTERS OR SYMBOLS

[75] Inventors: Ryuzo Miyano; Haruyuki Uenishi, both of Ikoma; Hisashi Akatani, Hirakata; Takenori Akamine, Ikoma, all of Japan

[73] Assignee: Matsushita Electric Industrial Co., Ltd., Osaka, Japan

[21] Appl. No.: 271,926

[22] Filed: Jun. 9, 1981

[30] Foreign Application Priority Data

Jun. 10, 1980 [JP] Japan ..... 55-78600

[51] Int. Cl.[3] ..... H01H 3/12

[52] U.S. Cl. ..... 200/308; 200/56 R; 200/159 B; 200/5 A; 340/712; 235/145 R

[58] Field of Search ..... 361/351, 400; 200/5 A, 200/5 R, 18, 56 R, 159 R, 159 B, 243, 308, 310, 312, 328, 340, 309; 340/711, 712, 719; 235/195 R

[56] References Cited

U.S. PATENT DOCUMENTS

| | | | |
|---|---|---|---|
| 3,917,915 | 11/1975 | Murata | 200/5 R |
| 3,932,722 | 1/1976 | Obata | 200/5 A |
| 3,969,600 | 7/1976 | Sims, Jr. | 200/5 A |
| 4,160,886 | 7/1979 | Wright | 200/308 |
| 4,311,996 | 1/1982 | Nakamura | 200/5 A |

*Primary Examiner*—G. P. Tolin

*Attorney, Agent, or Firm*—Wenderoth, Lind & Ponack

[57] ABSTRACT

A keyboard for inputting plural letters or symbols includes a number of switches, each of which has its associated letter or symbol displayed in a transparent window adjacent thereto. The keyboard is arranged such that a display card located beneath the transparent windows may be replaced so as to easily change the letters or symbols which are visible through the transparent windows.

6 Claims, 5 Drawing Figures

KEYBOARD FOR INPUTTING PLURAL LETTERS OR SYMBOLS

BACKGROUND OF THE INVENTION

The present invention relates to a keyboard on which a number of switches are placed side by side. An object of the invention is to provide switches which can visibly display letters or symbols, printed on cards or the like disposed below the keyboard, whereby a push-button on a desired symbol is pushed so as to feed a signal into a computer which corresponds to the desired letter or symbol.

Recently, a keyboard for a system for viewing letters or symbols so as to operate a switch corresponding thereto has appeared for use as an input device for an office computer, the computer being usable by a person who is not a professional operator. A conventional example of a keyboard for the above use is to form electrodes made from NESA film on transparent glass, the electrodes being touched directly by operator's fingers so as to feed a signal; such a keyboard is deficient with respect to control touch because the operator taps the glass surface with his or her fingers at every operation. Another method is to place a flexible sheet bearing letters or symbols on a panel on which a number of opaque switches are arranged, the switches being pushed from above the sheet. This method, which always deforms the flexible sheet, creates a problem with respect to the lifetime of the flexible sheet or the defacement of the written letters. A further method is to provide the switch itself with a transparent window molded of a transparent acrylic resin, so that an operator views a card placed underneath the switch through the window and urges the window corresponding to the letters or symbols printed on the card, thereby generating the required signal. Since windows may have their transparency deteriorate due to a "sink mark" when the acrylic resin is molded, flaws produced in the window, etc.

SUMMARY OF THE INVENTION

The present invention has been designed to provide a keyboard which is free from a deterioration in the operator's control touch, the cards bearing letters or symbols, or the transparency of the keyboard, thereby resulting in a keyboard which is superior in quality.

BRIEF DESCRIPTION OF THE DRAWINGS

Next, an embodiment of the invention will be detailed in accordance with the drawings in which.

DESCRIPTION OF THE PREFERRED EMBODIMENT

Figure 1:
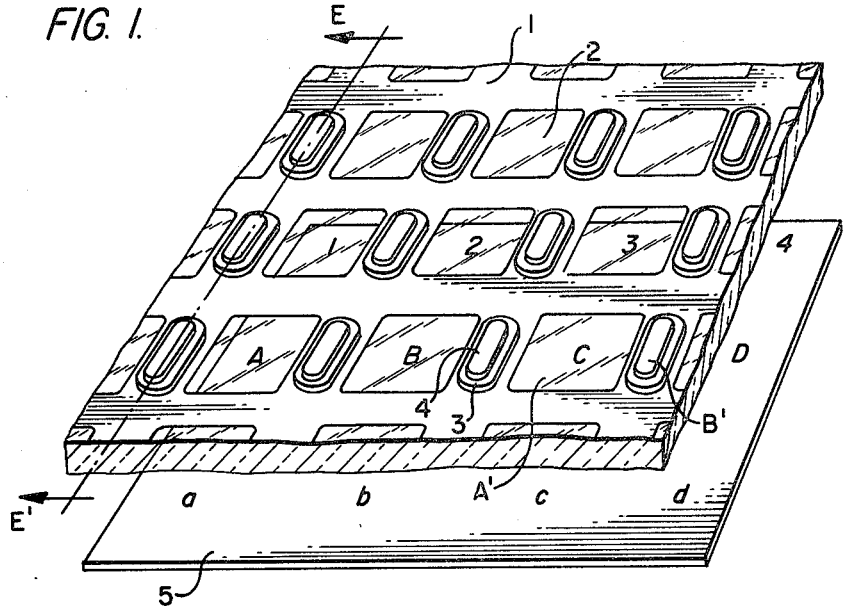
FIG. 1 is a perspective view in part of an embodiment of a keyboard of the invention.

FIG. 1 is a perspective view in part of a keyboard having a number of switches and transparent windows.

On a transparent acrylic plate are printed window frames 1 in a latticework and in an opaque black color and a number of transparent windows 2 are formed thereon, a switch case 3 being fitted into a portion of the window frame 1 and comprising a key top 4. A contact member (not shown in FIG. 1) is housed within switch case 3 and a switch unit is turned on or off by urging the key top 4. A display member 5 bears the desired letters or symbols thereon; the letters or symbols are visible through the transparent windows 2. For example, when a signal corresponding to the letter C which is printed on the display member 5 is to be generated, a switch unit B′ corresponding to a transparent window A′ is urged so as to generate a signal corresponding to C.

Figure 2:
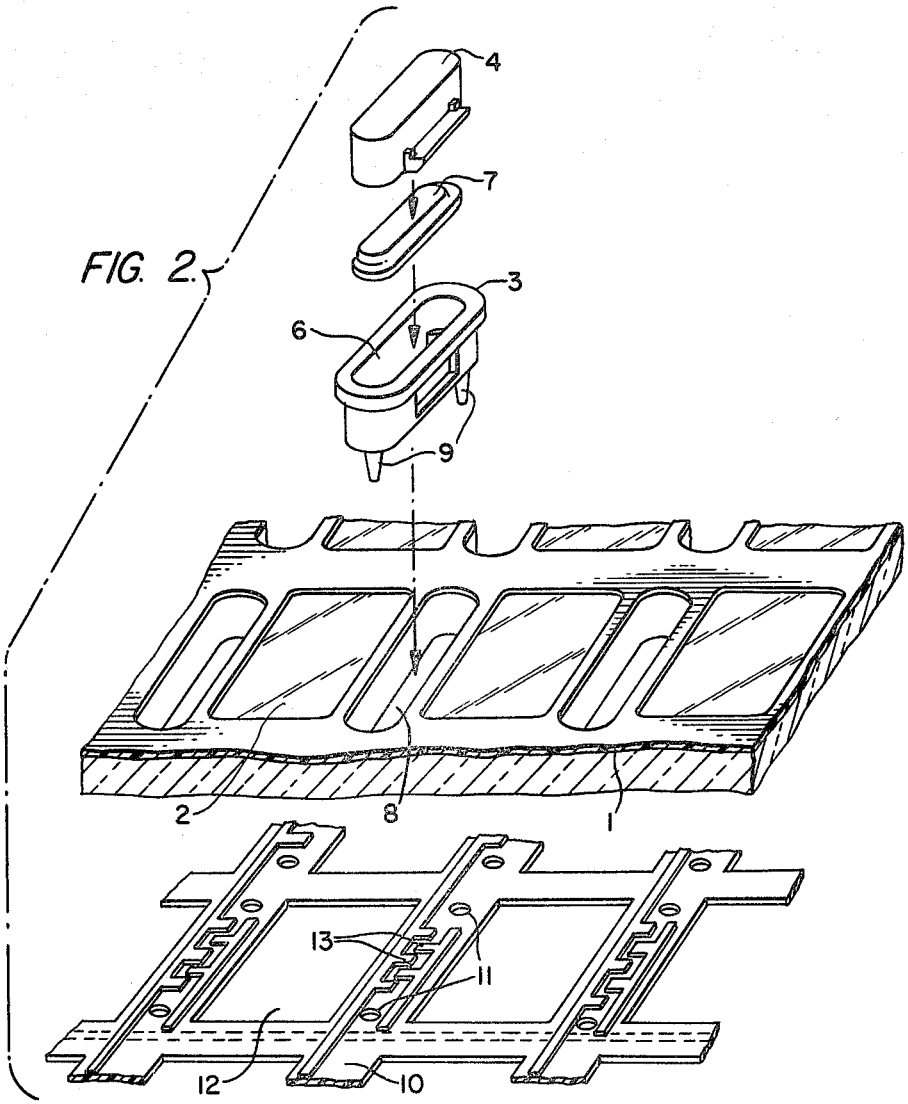
FIG. 2 is an exploded view of a switch portion with element 5 omitted for simplicity.

Next, a construction of the keyboard will be described in accordance with FIG. 2. A bore 6 is provided at the center of plastic switch case 3 and houses contact member 7 and key top 4. The switch case 3 of the switch member is fitted into a bore 8 provided in the printed frame 1 of transparent acrylic latticework, so that a number of switch units corresponding to a number of transparent windows 2 are formed. Two legs 9 are formed below switch case 3, and fitted into two small bores 11 provided in a printed circuit substrate 10, and heat-sealed at the lower surface of printed substrate 10, so that the printed substrate 10 is integral with the transparent acrylic body and switch unit. The printed substrate 10 is provided with a bore 12 at a position corresponding to a transparent window 2, and printed circuit electrodes 13 are provided at a position corresponding to bore 8 of opaque latticework 1. In order to individually detect each signal at a number of switch units, the lead wires from electrodes 13 form matrix circuits (not shown) by the use of both surfaces of the latticework of the printed substrate 10.

Figure 3:
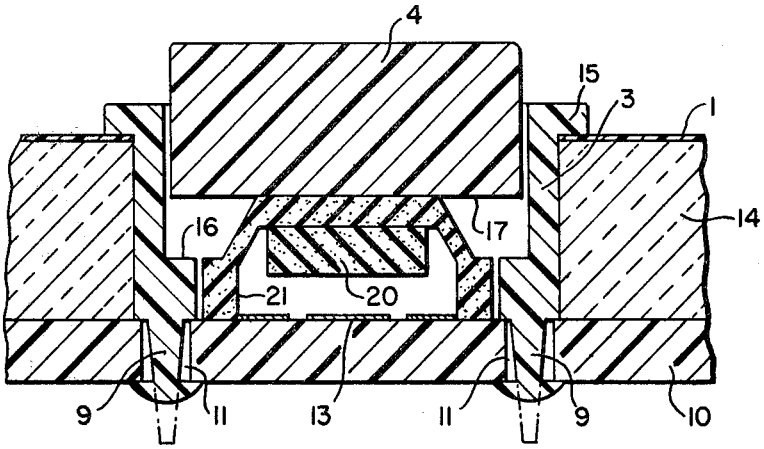
FIGS. 3 and 4 are sectional views of a switch portion with element 5 omitted for simplicity.
Figure 4:
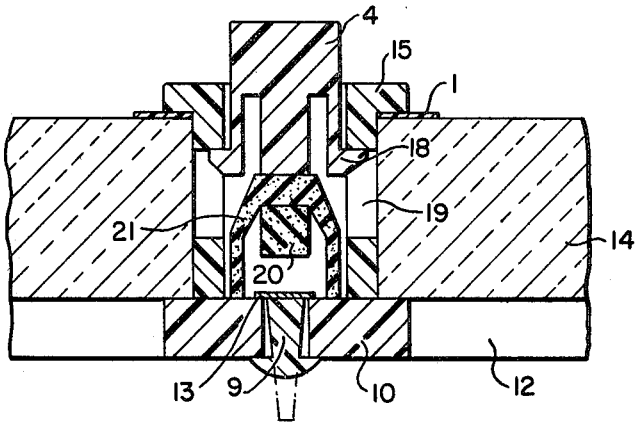
Figure 5:
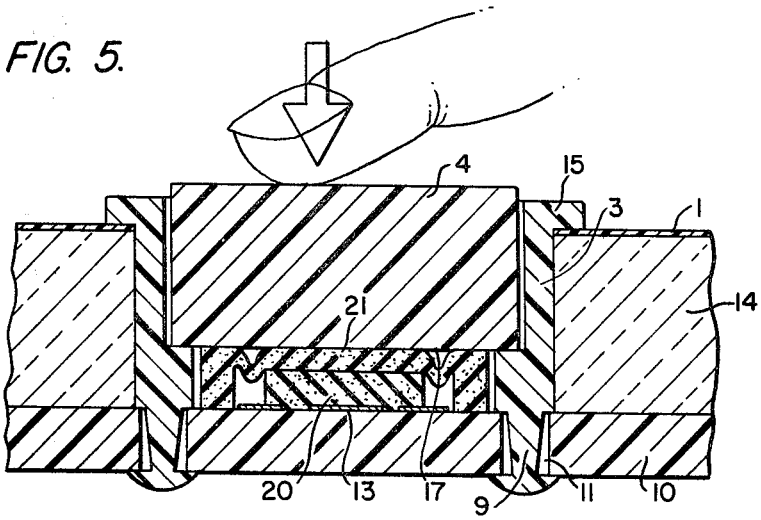
FIG. 5 is a sectional view of a switch portion when urged, (element 5 being omitted for simplicity).

The switch will be detailed in accordance with FIGS. 3, 4 and 5. Display member 5 has been omitted from these drawings for simplicity. FIG. 3 is a detail view of one switch in section taken on the line E-E′ in FIG. 1. FIG. 4 is a side view of the FIG. 3 switch, and FIG. 5 is a view showing the FIG. 3 switch when urged for operation.

At the surface of a transparent acrylic plate 14 is printed the opaque latticework frame 1, and switch case 3 is fitted in the plate 14. The switch case 3 is cylindrical, and has at the upper edge a flange-shaped stepped portion 15, and is provided at the lower portion with legs 9, which are fitted into bores in the printed substrate 10 and heat-sealed so as to be deformed from a condition shown by the broken lines to that shown by the solid lines, the switch case 3 and printed substrate 10 fixedly sandwiching the transparent acrylic plate 14 therebetween.

A stepped portion 16 is formed at a portion of the inner periphery of switch case 3, and abuts against the lower end 17 of the key top 4 when urged, thereby restricting the movement of key top 4 when urged. Elastically deformable pawls 18, as shown in FIG. 4, are provided at portions on the side of the key top 4. The pawls 18, when the key top 4 is inserted into switch case 3, contact the inner wall of the switch case 3 so as to be inwardly deformed, and after the key top 4 is urged into a predetermined position, the pawls 18 enter into bores 19 at the side walls of switch 3 and are restored, thereby preventing the key top 4 from escaping from switch case 3. A conductive rubber block 20 is integral with an elastic member 21 so as to constitute a contact part. When no key top 4 is urged, the conductive rubber block 20, as shown in FIG. 3, is not in contact with the printed substrate 10, but, upon the urging of the key top 4, the elastic member 21, as shown in FIG. 5, is displaced so as to allow the conductive rubber block 20 to contact the electrode 13 on the printed substrate 10 so as to turn the switch unit on or off.

As seen from the aforesaid embodiment, this invention is characterized in that one transparent panel is printed in latticework to form a number of transparent windows, switch units are incorporated in the latticework, and wiring media having electrodes are disposed below the transparent panel, the transparent panel and switch units being integral with each other. Instead of the aforesaid method of heat-sealing the legs of the switch cases to the printed substrate, for example, a method of affixing the printed substrate to the transparent panel, or affixing the substrate to the panel by the use of fastening parts, such as screws, are proposed.

Next, the effect of the invention will be described.

While the conventional keyboard provides electrodes of NESA plates at transparent windows so that the electrodes are touched by an operator's finger so as to provide an input, this invention, which uses conductive rubber switch elements, displaces the key top during operation to facilitate the creation of the clicking feeling, thereby allowing the operator to actually feel his or her finger's urging touch. Furthermore, while the conventional windows are touched directly by the operator's finger, those of the present invention need not be touched during operation, thereby solving the problem of dirty windows or the creation of flaws during extended usage.

While the conventional keyboard has transparent windows molded from acrylic resin, this invention has the transparent acrylic panel printed in latticework of an opaque color to form a number of transparent windows, thereby eliminating the defects of a "sink mark" or weld produced during the resin molding, thus overcoming the problem of the distortion of the letters or symbols when viewed or the deterioration of the transparency of the windows.

Although the keyboard of the present invention is larger in area than conventional keyboards due to arrangement of a number of windows and switches on the panel, this invention assembles switch parts in the transparent panel and the switch units are secured thereto, so that even when the switch panel body is deformed by heat or being urged, the printed substrate is disposed always along the switch panel body, thereby eliminating the defect due to different clearances between the conductive rubber blocks and the electrodes on the printed substrate.

The legs of the switch cases molded from plastic are inserted into bores provided at the printed substrate and heat-sealed thereto, thereby facilitating an integral assembly of the switch panel body, the switch unit and the printed substrate. Such a construction insures that the key top never escapes from the switch case due to the entry of the elastically displaceable pawls at the key top into the bores at the side walls of switch case and such a construction is adopted to easily integrate the switch panel, the switch unit and the printed substrate, and to facilitate the assembly of a key top merely by pushing same into its bore at the switch case.

What is claimed is:

1. A keyboard comprising:

a printed circuit substrate having top and bottom surfaces and having a latticework configuration forming a plurality of apertures and also having a plurality of electrodes arranged on frames of said latticework; a transparent panel placed on said top surface of said printed circuit substrate and having through apertures arranged at positions opposite to said plurality of electrodes;

a plurality of switch members which are fitted into said through apertures in said transparent panel;

a display member arranged on said bottom surface of said printed circuit substrate, said display, member having a plurality of indicia contained thereon;

said keyboard being arranged such that said printed circuit substrate, said transparent panel and said plurality of switch members are integral with each other and with said display member, and said indicia of said display member are disposed at positions which are visible through said apertures of said printed circuit substrate, wherein each of said plurality of switch members corresponds to a respective one of said plurality of visible indicia.

2. A keyboard according to claim 1, wherein said transparent panel comprises a transparent plate member on which frames of a lattice-like shape in an opaque color are printed so to form a plurality of transparent windows through which said plurality of indicia are visible.

3. A keyboard according to claims 1 or 2, wherein each of said plurality of switch members comprises:

a contact urged so as to be displaced either on or off, a key top, and a switch case housing said contact and key top therein and inserted into a respective one of said apertures of said transparent panel.

4. A keyboard according to claim 3, wherein each of said switch cases has legs arranged at positions opposite to said printed circuit substrate and said printed circuit substrate is provided with apertures in which said legs are fitted at positions corresponding to said legs such that said legs are heat-sealed to said apertures in said printed circuit substrate, thereby being secured thereto; and wherein each of said switch cases comprises:

a cylindrical member having a stepped portion at the outer periphery thereof, and having a stepped portion at the inner periphery housing said contact and key top for restricting movement of said key top when urged, and having wall perforating apertures at portions on the inner peripheral wall side which are engageable in part with said key top;

each of said switch cases being fitted into a respective one of said apertures in said latticework frame of said transparent panel until said stepped portion at the outer periphery contacts said panel.

5. A keyboard according to claim 4, wherein said key top comprises elastically displaceable pawls which are arranged such that said pawls are displaced when inserted into said switch case, and said pawls are fitted into said side wall perforating apertures after said key top is inserted into said switch case and are simultaneously restored from their displacement, thereby holding said key top within said switch case.

6. A keyboard according to claim 1, wherein said printed circuit substrate is fixable to said switch case, holds said transparent panel sandwiched between said printed circuit substrate and said switch case, and has a plurality of apertures which are respectively substantially coincident with and positioned in correspondence with said transparent windows of said transparent panel, and wherein lead wires of said electrodes which are provided at positions on said printed circuit substrate corresponding to said switch members are printed on said substrate so as to be arranged outwardly from said printed circuit substrate.

* * * * *